US005592723A

United States Patent [19]

Leijonhufvud et al.

[11] Patent Number: 5,592,723

[45] Date of Patent: Jan. 14, 1997

[54] BURIAL COFFIN ARRANGEMENT

[75] Inventors: Carl B. Leijonhufvud, Upsala; Jan-Ake Hallén, Partille, both of Sweden

[73] Assignee: Carl Leijonhufvud, Upsala, Sweden

[21] Appl. No.: 374,717

[22] PCT Filed: Jul. 28, 1993

[86] PCT No.: PCT/SE93/00643

§ 371 Date: Jan. 26, 1995

§ 102(e) Date: Jan. 26, 1995

[87] PCT Pub. No.: WO94/03139

PCT Pub. Date: Feb. 17, 1994

[30] Foreign Application Priority Data

Jul. 30, 1992 [SE] Sweden ..... 9202262

[51] Int. Cl.[6] ..... A61G 17/00

[52] U.S. Cl. ..... 27/2; 27/32; 27/35

[58] Field of Search ..... 27/2, 32, 35, 4, 27/12, 33, 34

[56] References Cited

U.S. PATENT DOCUMENTS

| | | | |
|---|---|---|---|
| 1,048,361 | 12/1912 | Sievert . | |
| 1,065,579 | 6/1913 | Bentley . | |
| 2,167,001 | 7/1939 | Oppenheim | 27/32 |
| 3,050,818 | 8/1962 | Phillips . | |
| 3,810,282 | 5/1974 | Doggett . | |
| 4,177,543 | 12/1979 | Angermann . | |
| 5,058,248 | 10/1991 | Sedlak | 27/35 X |

OTHER PUBLICATIONS

Derwent's abstract, No. L5775 E/35, week 8235, Abstract of SU, 876130 (Lengd Communal Serv), 30 Oct. 1981.

*Primary Examiner*—Kien T. Nguyen

*Attorney, Agent, or Firm*—Jacobson, Price, Holman & Stern, PLLC

[57] ABSTRACT

A burial coffin arrangement including a ceremonial casket which can be used a number of times and which is provided with decorative material and which can be placed over or lifted from a disposable inner casket which is made from a material which is not detrimental to the environment when incinerated and when decomposing. The ceremonial casket includes mutually opposing side walls which are pivotally mounted at the top thereof to the upper part of the ceremonial casket. The side walls can be moved towards one another to form wedge-like inwardly inclined outer walls for the inner casket in a traditional manner. When the side walls are brought towards one another, shoulders on the side walls pass into form-bound engagement with the inner casket so that the caskets can be lifted together. When the ceremonial casket is to be lifted away from the inner casket in the case of cremation or when the inner casket is lowered from the ceremonial casket in the case of burial, the side walls are moved apart.

14 Claims, 4 Drawing Sheets

BURIAL COFFIN ARRANGEMENT

FIELD OF THE INVENTION

The present invention relates to a burial coffin arrangement comprising an outer open-bottom ceremonial casket and an inner casket which is received within the outer casket and which has a downwardly wedge-shaped and inwardly inclined bottom part, such as to enable the two caskets to be mutually separated by vertical relative movement therebetween.

BACKGROUND OF THE INVENTION

This type of coffin can be said to be of topical interest in present times. In keeping with the growing demands for a protected environment, burial coffins will preferably be manufactured from an environmentally friendly material which will decompose naturally in the ground or which can be incinerated without detriment to the environment. At the same time, tradition requires the coffin to carry ornamentation and internal decorations which are made from environmentally unsuitable materials and therefore in conflict with the aforesaid. An environmentally inner casket which is lowered from a ceremonial outer casket into an earthen grave at the time of burial or from which the outer casket is lifted prior to cremation is therefore an attractive solution to the problem. Earlier known constructions have primarily been directed to reducing costs in conjunction with burials. Prior patent publications U.S. Pat. No. 1,065,579 and U.S. Pat. No. 3,050,818 disclose examples of earlier coffin constructions. The use of these known coffins has been restricted in practice. Probably, this is because it has been considered necessary to give the ceremonial caskets a box-like shape of exaggerated width, therewith departing too far from the design that conventional piety demands.

SUMMARY OF THE INVENTION

The object of the present invention is to provide an environmentally friendly combination of outer ceremonial casket and inner casket with which the vertical mobility of the inner casket relative to the outer ceremonial casket is obtained while retaining the traditional design of the outer casket. The caskets shall also be usable effectively in cremation and shall be capable of being handled readily both in cremation and in burial ceremonies.

BRIEF DESCRIPTION OF THE DRAWINGS

The invention will now be described in more detail with reference to the accompanying drawings, in which

FIGS. 8–11 illustrate an alternative embodiment of the invention, wherein FIG. 8 illustrates a slightly enlarged half cross-sectional view of the ceremonial and inner caskets, corresponding essentially to FIG. 4 but seen along the line 8—8 in FIG. 10. FIG. 9 is a fragmentary view showing an alternative position of a part of FIG. 8. FIG. 10 is a divided longitudinal section view of the ceremonial casket taken on the line 10—10 in FIG. 8, and shows in side-view the inner casket placed within the ceremonial casket. Finally, FIG. 11 is a schematic, exploded perspective view of the latching devices in FIG. 10 which function to hold the side walls of the ceremonial casket together.

DETAILED DESCRIPTION OF THE PREFERRED EMBODIMENTS

Figure 2:
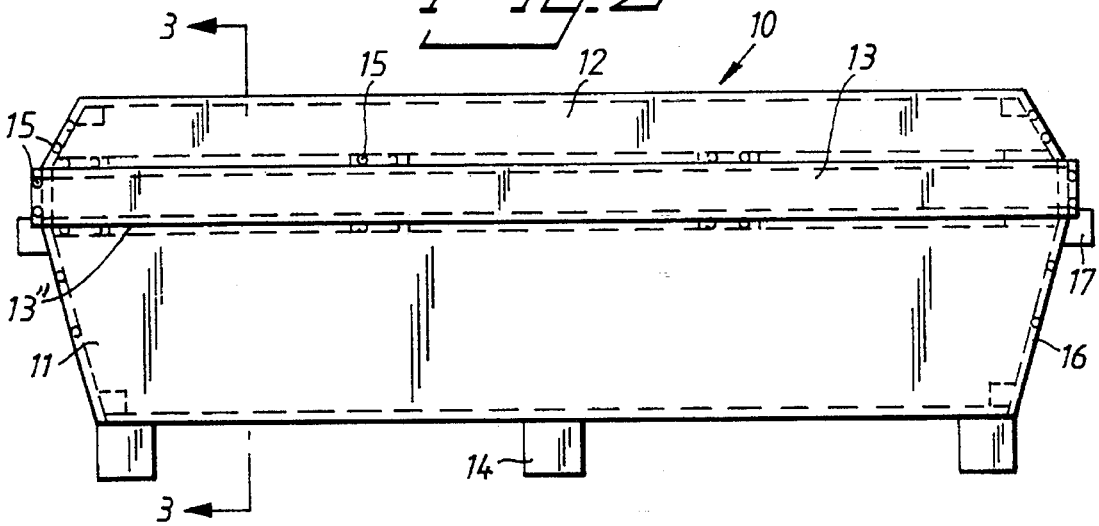
FIG. 2 is a side view of the inner casket, which is concealed in the FIG. 1 illustration.

The inner casket 10 shown in FIG. 2 is comprised entirely of combustible material and includes a bottom part 11 having walls 16 and a top part 12, wherein the top and bottom casket parts have an appropriately wedge-shaped and inwardly inclined configuration at both the long and the short sides thereof. These parts can be prefabricated and stored in groups per se and subsequently joined together with the aid of side elements 13 or with the aid of suitable strips, to form a casket. The casket components may be joined together with dowels 15, aided with glue when so required. The units and the glues shall have a composition which is unharmful to the environment when decomposing or when incinerated. The illustrated casket is assumed to be made purely from wood, preferably in the form of tongue-and-grooved spruce boards or panels.

Figure 1:
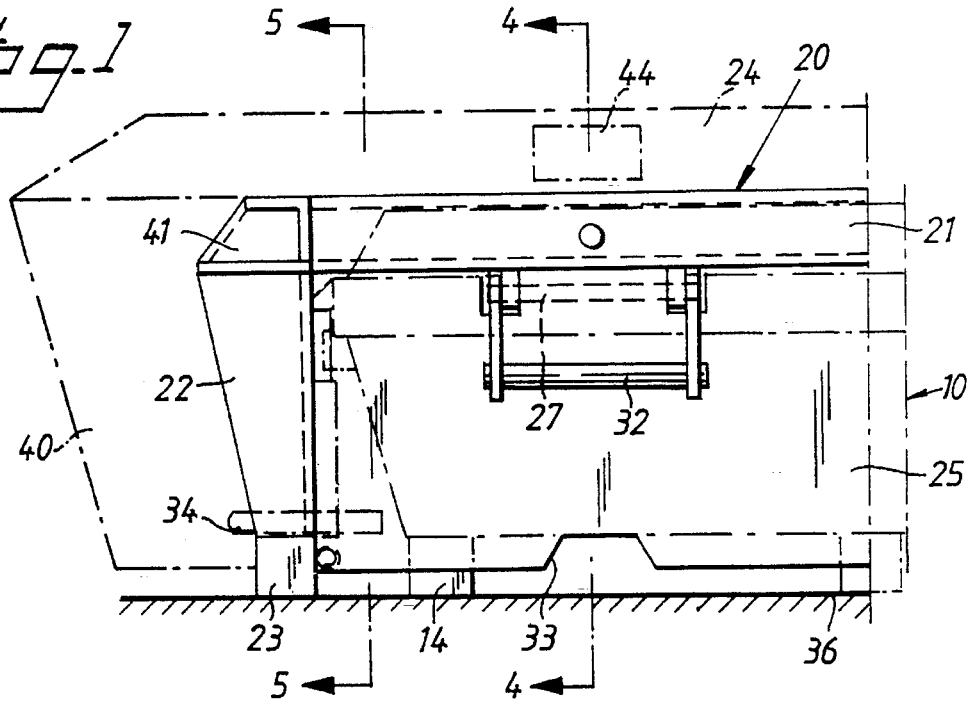
FIG. 1 is a partial side view of a ceremonial casket which is placed over an inner casket, shown in chain lines, both in accordance with the invention. The Figure emphasizes the supportive framework of the ornamental casket and shows a contemplated outer contour of the ornamental casket, also in chain lines.
Figure 4:
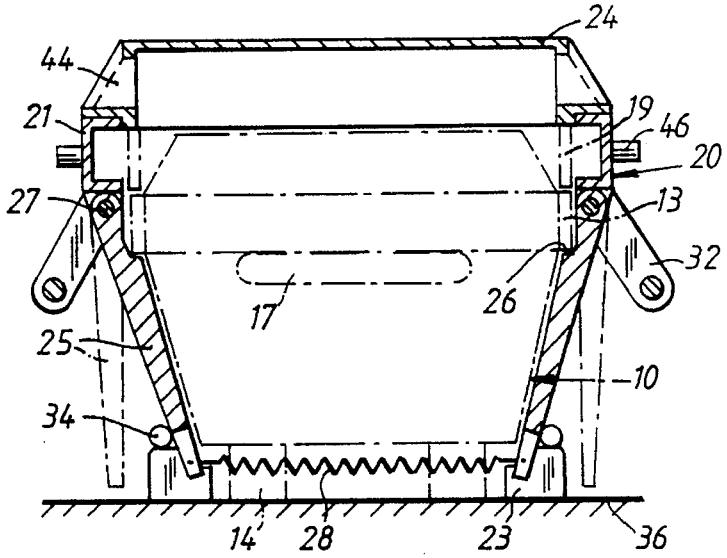
FIG. 4 is a cross-sectional view taken on the line 4—4 in FIG. 1 and shows the side-walls of the ornamental casket brought together adjacent the inner casket, which is shown in end-view and in chain lines.

The inner casket 10 is intended to be received within the ceremonial casket 20, FIGS. 1 and 4, in conjunction with a burial ceremony. The ceremonial casket 20 includes a portal-like supportive structure which is comprised of a rectangular upper frame structure 21 having attached thereto mutually opposing end-walls 22 which form the legs of the portal. Aluminium alloy is a suitable material for the construction of the portal and the sides of the ceremonial casket. The end-walls 22 include feet 23. The size of the frame structure 21 is chosen so as to allow sufficient clearance for the casket 10 to pass easily through the frame structure.

Figure 3:
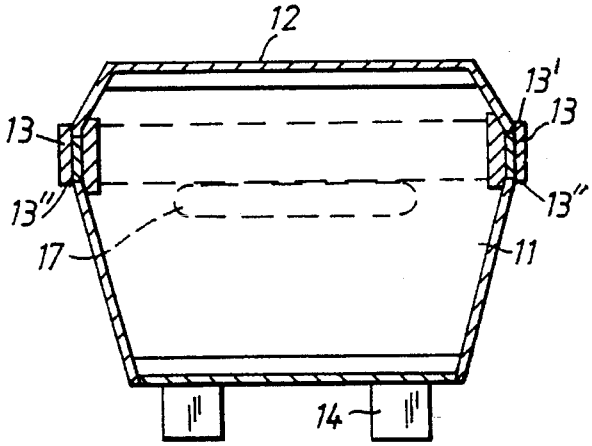
FIG. 3 is a cross-sectional view of the inner casket, taken on the line 3—3 in FIG. 2.
Figure 5:
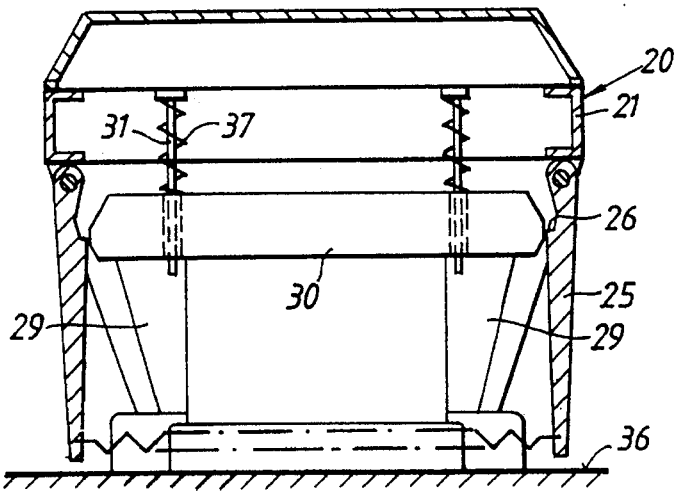
FIG. 5 is a cross-sectional view taken on the line 5—5 in FIG. 1 and shows the ornamental casket lifted from the inner casket and standing alone on a supporting surface.
Figure 7:
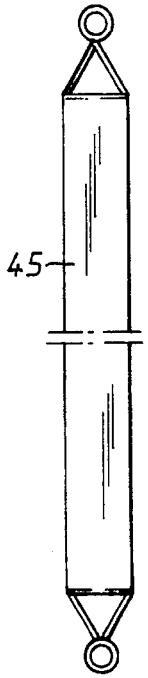
FIG. 7 illustrates a strap for mutually securing the caskets.
Figure 6:
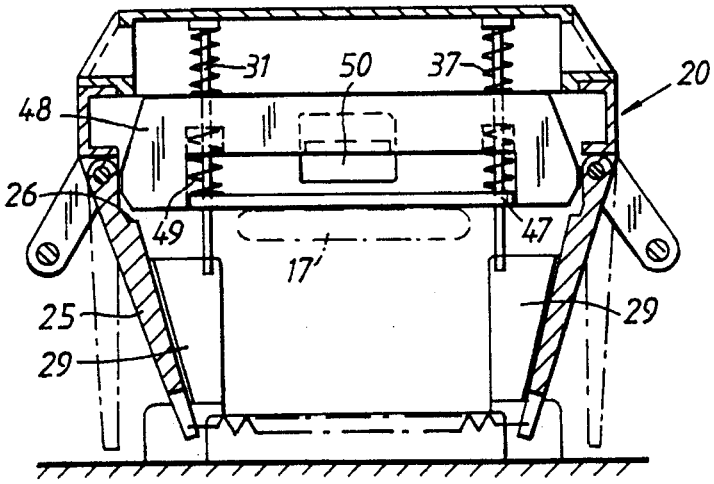
FIG. 6 illustrates an alternative embodiment to the embodiment illustrated in FIG. 5.

The long sides of the frame structure 21 provide attachments for pivot shafts or hinge means 27 on which mutually opposing side-walls 25 are hung so as to be pivotal between an inwardly swung position in which they form a wedge-shaped configuration, FIG. 4, and an outwardly swung, separated position, FIG. 5. The ceremonial casket 20 has an open bottom between the side-walls in both positions of said side-walls. The extent to which the side-walls can be swung inwardly is defined by stop shoulders 29, FIGS. 5, 6, provided on the inner surface of the end-walls 22 and against which the side-walls 25 will abut when thus positioned. Mounted in the vicinity of the hinges 27 on the-inner surfaces of the side-walls 25 and conveniently extending along the whole length of said side-walls are engagement means 26 which in the wedge-shaped inwardly swung state of the side-walls lie adjacent the bottom edge-surfaces 13", FIG. 3 of the side-elements 13 of the inner casket 10, whereby as the ceremonial casket 20 is lifted the inner casket 10 will also be lifted, provided that the side-walls 25 are positively held against the shoulders 29 or are locked. The side-walls 25 can be brought together with the aid of springs 28 stretched between the side-walls adjacent each end-wall 22. At the same time, or as an alternative when the side-walls 25 hang freely, the side-walls 25 can be locked in their inwardly swung positions with the aid of a generally U-shaped locking device 34 which is mounted adjacent the end-walls 22 and which straddles the feet 23 over each end-wall 22, FIG. 1 and 4, so that the ends of the locking device will lie outside the side-walls 25. FIG. 7 illustrates an alternative locking device in the form of a harness or strap 45, which is intended to be secured around the side-walls 25 through the recesses 33 shown in FIG. 1 and which can be passed beneath the inner casket 10 and attached to hooks 46, FIG. 4, on the outer sides of the frame structure 21 so that the two caskets 10, 20 can be transported in unison.

FIG. 5 illustrates a mechanism which when placing the ceremonial casket 20 over the inner casket 10 functions to automatically swing the side-walls 25 towards one another. Mounted on the end-wall shoulders 29 is an elongated locking bar 30 which is guided for vertical movement on guide pins 31 and which moves vertically downwards under its own weight and/or under the action of springs 37 mounted on the guide pins. In the illustrated case, the bar 30 has dropped into the engagement means 26 on respective side-walls, therewith holding the side-walls 25 mutually separated. As the ceremonial casket 20 is lowered over the inner casket 10, a strip 17 on respective end-walls 16 of the inner casket slides in between the shoulders 29 and up beneath the bar 30 and finally lifts the bar 30 out of the engagement means so that the side-walls 25 will be drawn towards one another by the springs 28 into a wedge-like configuration.

FIG. 4 illustrates the caskets 10, 20 placed on a flat supportive surface 36, for instance catafalque. In the bottom opening between the side-walls, the feet 14 of the inner casket 10 are conveniently slightly higher than the feet 23 of the ceremonial casket. This ensures that the engagement means 26 on the side-walls 25 will be spaced slightly beneath respective side-elements 13 on the inner casket, so as to relieve the ceremonial casket of the weight of the inner casket.

The upper part of the ceremonial casket 20 has the form of a lid 24 which covers the frame structure 21 and which can be secured thereto at appropriately distributed securing points. Flat tongues 19 which hang down from the under-surface of the lid 24 form abutments which when lifting the inner casket 10 from beneath results in simultaneous lifting of the ceremonial casket 20 via the outer upper edge surfaces 13' of the side-elements 13, FIG. 3. If it is preferred to place the lid 24 loosely on the ceremonial casket, the inner casket 10 can be lifted up or lowered through the frame structure 21 to the position shown in FIG. 4, with the lid 24 removed. Lifting of the casket can be facilitated with the aid of rope-loops (not shown) attached to the side-elements 13 of the inner casket 10.

The mutually opposing end-walls 22 of the portal frame structure are provided with hang-on ends 40 which are fastened to conveniently arranged end-wall openings 41, as indicated in FIG. 1. These hang-on ends 40 will provide a traditional, expected design and, if desired, the hang-on ends can be adapted to the design of the lid 24.

The ceremonial casket 20 is either handled manually or with the aid of lifting devices hooked to the handles 32 or to the hooks 46. When the lid 24 is permanently attached to the ceremonial casket, a mechanical lifting stirrup can be inserted into prepared lid-openings 44, FIGS. 1, 4, such as to enable the ceremonial casket 20 to be lifted alone or together with the attached inner casket 10 in the crematorium. A fork-lift truck may also be used to lift the two caskets simultaneously while using the side-recesses 33 through which the truck forks have access to the bottom of the inner casket 10, or through which a coffin-lowering strap can be passed in the case of an earth burial ceremony.

The ceremonial casket 20 is intended for multiple use and is provided with an appropriate lining of noble-wood veneer and/or a plastic material and fabric for decoration purposes. In the case of cremation, the ceremonial casket 20 is lifted from the catafalque 36 and the inner casket moved into the crematorium furnace. In the case of a burial, the caskets 10, 20 are moved from the catafalque 36 to a supportive structure over the grave and the inner casket then lowered into the burial hole, for instance either manually with the aid of straps or mechanically in a conventional manner, for instance as described in the earlier patent specifications cited in the introduction.

It will be noted that when the side-walls 25 have been brought together to the position illustrated in FIG. 4, the caskets 10, 20 will be mutually locked against separation in a vertical direction. The caskets are released from one another, for instance by lifting one end of the two caskets away from the supportive surface 36 through a distance of one centimeter and swinging-out the unsecured side-walls 25 manually, thereby inclining the inner casket 10 and enabling the casket to slide down from the opposing engagement means 26 onto the supportive surface or onto straps by means of which the casket is lowered into the grave. As the caskets are separated, the locking bars 30 are lowered to the position shown in FIG. 5 and latch the side-walls 25 in their mutually separated positions at both end-walls 22. The locking bars 30 can be omitted when the upper part 12 of the inner casket is configured with a conical angle such as to automatically move the side-walls 25 apart as the ceremonial casket 20 is moved down over the inner casket 10.

FIG. 6 illustrates an alternative locking bar which is comprised of two parts 47, 48 between which springs 49 are mounted on guide pins 31. The springs 49 are stronger than the springs 37. Access can be had to the upper part 47 of the locking bar through an opening 50 in the end-wall 22, so as to enable the locking bar to be pressed down, either manually or with the aid of force transmitting means provided with levers and suitably mounted in the ceremonial casket 20. When the strips 17 on the inner casket 10 move the locking bars 47, 48 upwards, as described with reference to FIG. 5, only the weaker springs 37 are compressed and the upper locking-bar part 48 is thus released from engagement with the engagement means 26 on the side-walls 25 to permit inward movement of said side-walls. When the upper locking-bar part 48 is pressed down from this position, the stronger springs 49 are compressed and the locking-bar part 48 is cammed out of the engagement means 26 and the side-walls 25 so as enable the caskets 10, 20 to be separated vertically.

The springs 28 which function to draw the side-walls 25 towards one another are shown schematically in the Figures. In practice, the springs are mounted beneath the inner wall of the end-walls 22 and relative to the feet 23 such as to enable the strips 17 on the inner casket 10 to move freely past the springs 28 as the ceremonial casket 20 is lowered down over the inner casket 10.

The embodiment illustrated in FIGS. 8–11 is primarily intended to achieve a lighter alternative to the supportive end-walls 22 of the ceremonial casket 20, to relieve the load on these end-walls by supporting parts of the casket frame on the inner casket 10, and construct the hinge-halves of the pivot axles 27 as a supportive stiffening for the casket parts.

Figure 8:
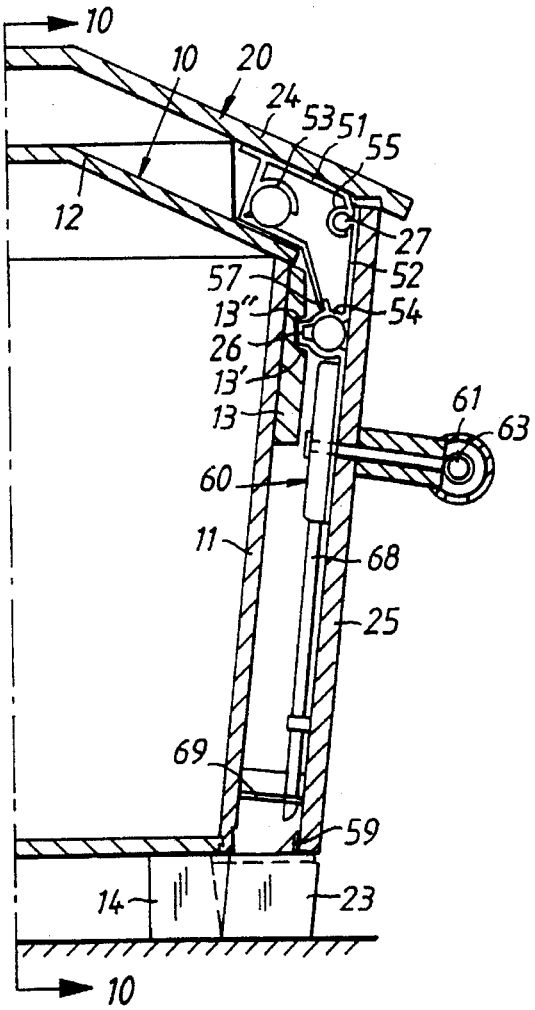
Figure 9:
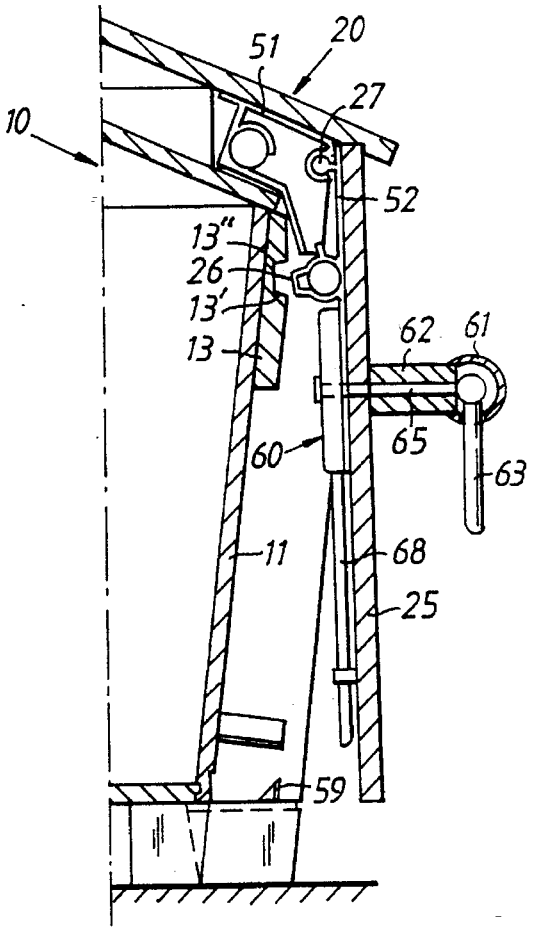

The hinge-halves 51, 52 are comprised of elongated aluminium profiles. One hinge-half 51, the upper hinge-half, includes a tubular part 55 in which the pivot pin 27 forming part of the other hinge-half 52, the bottom hinge-half, is inserted so as to pivotally connect the hinge-halves 51, 52. In FIGS. 8, 9, the upper hinge-half 51 is fixed, i.e. screwed to the inside of the lid 24 of the ceremonial casket 20 in some suitable manner, and the lower hinge-half 52 is secured to the side-wall 25. This enables the side-walls of the ceremonial casket 20 to be swung around the pivot pin or hinge 27, from the position shown in FIG. 8 to the position shown in FIG. 9, and back again. At the same time, the upper hinge-half 51 rests on the lid 12 of the inner casket 10 and is therewith relieved of load.

A larger tubular profile part 53 forms an inner, axial stiffening in the upper hinge-half 51, while the lower hinge-half 52 has a tubular, stiffening profile part 54 which forms the engagement means 26 of the side-wall 25 for engagement with the inner casket 10, similar to the embodiment aforedescribed with reference to FIG. 4, although improved by the form-bound engagement both upwards and downwards. The inner casket thus has a modified side-element 13 in the form of a strip which is provided with a longitudinally extending groove 56, FIG. 10, in which that part 54 of the lower hinge-half 52 having the tubular engagement means 26 engages as the side-walls 25 are moved together. The opposing walls of the groove 56 form abutment elements 13", 13' for the engagement means 26, whereby the caskets 10, 20 are mutually connected for common vertical movement in the position in FIG. 8 and are mutually free from one another in the position in FIG. 9 in a constructively stronger manner than in the FIG. 4 embodiment.

When required, the hinge-halves 51, 52 can be made mutually rigid by welding said hinge-halves at their common contact line, reference 57 in FIG. 8. This has been effected at the end-walls 22 in FIG. 10, so as to obtain in respect of said end-walls an angle-rigid connection with opposite ends of the lid 24. The end-walls 22 and the mutually welded hinge-halves 51, 52 form together with the lid 24 and the feet 23 the portal-like supportive framework of the ceremonial casket 20, when said casket stands on a supportive surface separate from the inner casket 10. A block 58 is attached to the underside of each of the two mutually opposed upper hinge-halves 51, these blocks 58 assisting in guiding the ceremonial casket 20 into its correct position as the casket is lowered over the inner casket 10, wherein the hinge-halves 51 of the long sides lie on the lid 12 of the inner casket 10. The feet 23 of the end-walls carry angle irons which act as end-wall shoulders 59 and which form adjacent the end-walls 22 stop means which define the extent to which the side-walls can be swung inwardly.

Figure 10:
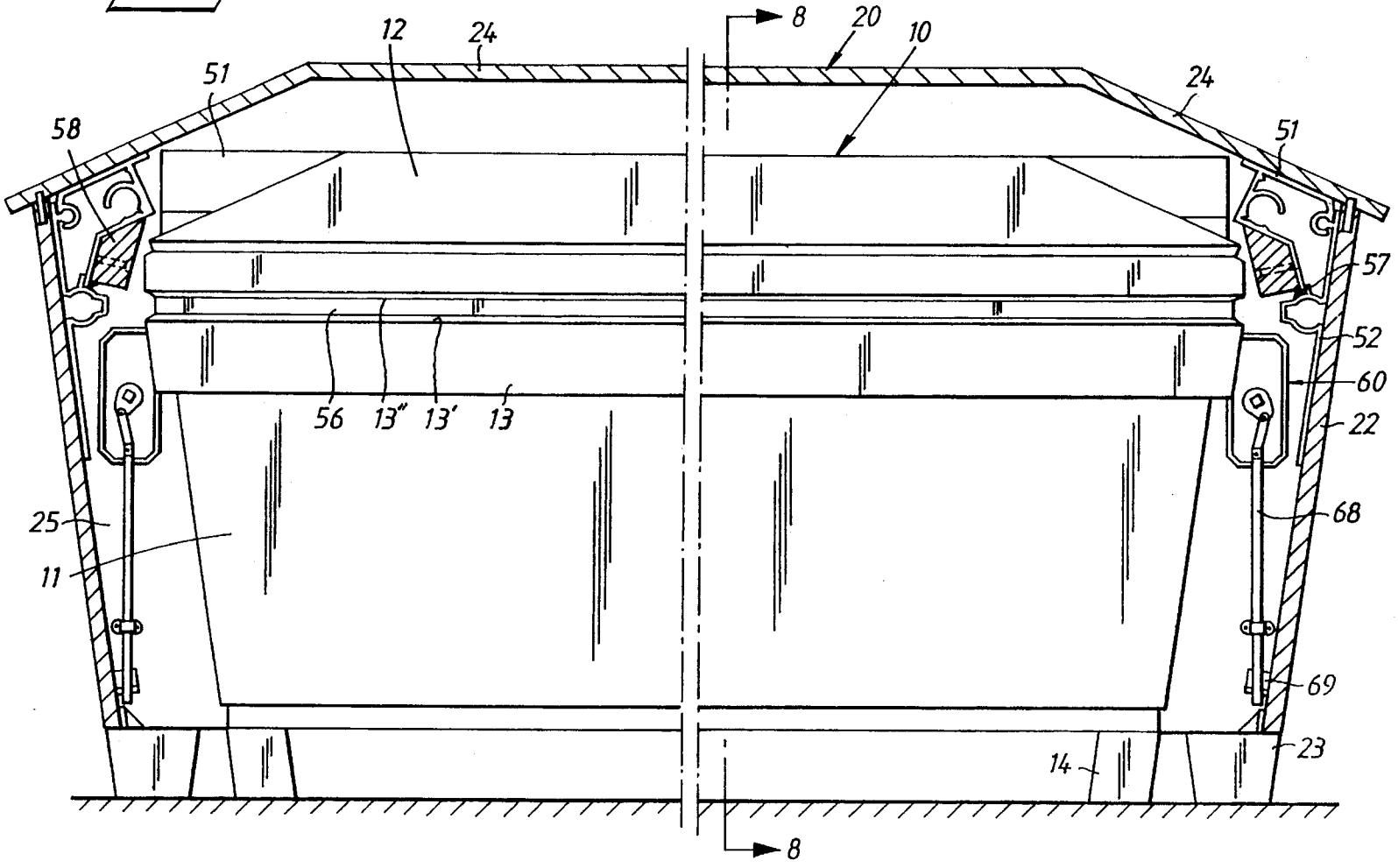

In practice, the upper hinge-halves 51 may have the form of profiled sections and extend along the whole of the inner length of the ceremonial casket 20, as indicated in FIG. 10, and be secured to the welded upper hinge-halves 51 in the end-walls 22 in some suitable manner, for instance by welding, so as to form a rigid, rectangular supportive frame. When lower demands are placed on mechanical strength, the hinge-halves on the casket sides may alternatively be divided into separate, axially spaced hinge sections (not shown) and the main part of the supportive function taken over by the actual upper part 24. According to an alternative embodiment, not shown, the pivot pin 27 or hinge means may conventionally have the form of a separate shaft, when required. In this case, the lower hinge-halves 52 are provided with a tubular passageway which is positioned coaxially adjacent the tubular passageways 55 of the upper hinge-halves 51 and the pivot pin 27 is inserted in the tubular passageways so as to form the hinge. If so desired, the tubular profiled parts 53, 54 of the hinge-halves 51, 52 can be used to receive loose handle parts from the end-walls or from the side of the casket, so as to provide alternative means for carrying the casket manually or alternative attachment points for mechanical lifting devices.

Figure 11:
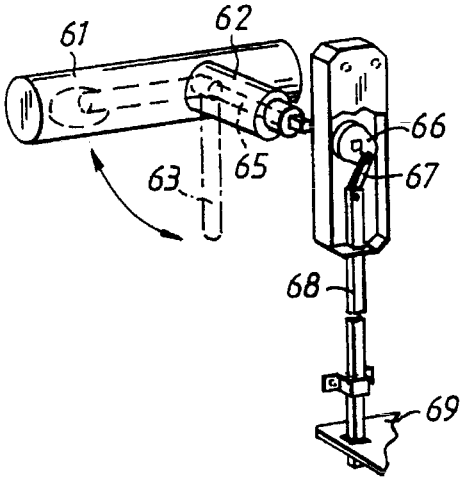

Conventional espagnolette locks 60, FIG. 11, are mounted on the opposing inner ends of the side-walls 25, FIG. 10. Tubular handles 61 are fastened with a tubular shaft 62 to the outside of the side-walls 25. A lever 63 which can be swung into a respective handle 61 drives an eccentric 66 in the lock 60 via an inner shaft 65 in the tubular shaft 62. As the eccentric 66 is rotated, a link 67 moves a latching rod 68 into and out of engagement with a lock plate 69 attached to the bottom of the end-walls 22. The arrangement is such that when the lever 63 is swung into the handle 61, for instance when wishing to lift both caskets 10, 20 simultaneously with the aid of handles 61, the side-walls 25 are locked in the lock plate 69 of the end-walls 22 by means of the latching rods. The caskets 10, 20 are then mutually locked in the position shown in FIG. 8. When the levers 63 are moved to the position shown in FIG. 9, the latching rods are drawn from the lock plate 69 and the side-walls 25 can be moved out to the free position shown in FIG. 9, so as to enable the ceremonial casket 20 to be lifted away by means of the handle 61.

The use of the caskets 10, 20 illustrated in FIG. 8–11 is essentially similar to the use of the first described caskets and need not therefore be described in detail.

We claim:

1. A burial coffin arrangement comprising an open-bottom outer ceremonial casket and an inner casket to be received in the ceremonial casket, the inner casket having a downwardly wedge-shape and inwardly inclined lower part, means to enable the caskets to be separated from one another by vertical relative movement therebetween, the ceremonial casket including mutually opposing side-walls which are pivotally mounted at the tops thereof to an upper part of the ceremonial casket by hinge means, so that when the bottom parts of said side-walls are moved apart, said caskets are able to move relative to one another in a vertical direction, and when the bottom parts of said side-walls are moved towards one another, the side-walls form a wedge-shaped outer-wall configuration which is adapted to the lower part of the inner casket.

2. An arrangement according to claim 1, wherein the ceremonial casket is provided on end-walls thereof with end-wall shoulders against which said side-walls can be brought to form said wedge-shape.

3. An arrangement according to claim 2, wherein latching means which act between the end-walls and the side-walls of the ceremonial casket latch the side-walls against outward movement so as to lock said side-walls in a wedge-shaped configuration in abutment with the end-wall shoulders.

4. An arrangement according to claim 3, wherein said latching means are formed by espagnolette locks at opposite ends of the inside of said side-walls, each of said locks being maneuverable by means of an operating lever which pivotally coacts with a respective casket handle mounted on the outside of the ceremonial casket, such that when the lever is swung towards the handle, a latching rod of the lock is moved into engagement with a lock plate mounted on the end-walls of the ceremonial casket and which releases said locking engagement when swung away from the handle.

5. An arrangement according to claim 1, wherein the arrangement includes engagement means adjacent the hinge means of said side-walls so as to enable the side-walls of the ceremonial casket to be secured to the inner casket in a form-bound fashion to permit the two caskets to be lifted together when the side-walls are brought together to form said wedge-like configuration, and can be released from the inner casket for relative vertical movement between the two caskets by moving the side-walls apart.

6. An arrangement according to claim 5, wherein the ceremonial casket is provided at end-walls thereof with locking means arranged to fall between the side-walls so as to actively hold the side-walls apart and thereby permit relative vertical movement between the caskets; and in that the end-walls of the inner casket are provided with shoulders which function as camming elements for inactivating the locking means of the ceremonial casket as the caskets are brought together in a vertical direction.

7. An arrangement according to claim 6, wherein spring means bias the side-walls towards respective end-wall shoulders.

8. An arrangement according to claim 5, wherein the ceremonial casket includes an upper part in the form of a frame having long-sides from which the side-walls of the ceremonial casket are suspended and portal legs which form part of opposing end-walls of the ceremonial casket.

9. An arrangement according to claim 8, wherein when the caskets are combined vertically, the ceremonial casket is supported on the inner casket via the long sides of the frame.

10. An arrangement according to claim 5, wherein the side-walls of the ceremonial casket are suspended from mutually hinged, flexurally rigid metal profiled sections of which at least one upper profile forms an upper hinge-half which is secured to the inner surface of the upper part of the ceremonial casket, and at least one lower profile forms a lower hinge-half which is secured to the inner surface of the side-walls so that when the caskets are combined, the upper hinge-halves rest on the inner casket, and the lower hinge-halves have a profile stiffening formed by the abutment, which can be form-bound connected to the inner casket when the side-walls are swung in towards said casket.

11. An arrangement according to claim 10, wherein the inner casket at each of two long sides thereof is provided with a longitudinally extending side-strip having an elongated groove in which the engagement means of the lower hinge-halves are intended to engage in form-bound fashion so as to prevent vertical relative movement of the two caskets both, upwardly and downwardly.

12. An arrangement according to claim 10, wherein said inner casket includes a bottom part and a top part which are joined in a form-bound fashion by intermediate side-strips, and respective longitudinally extending side-strips are provided on their outer surface with a laterally facing and longitudinally extending groove whose opposing walls form downwardly and upwardly directed abutment elements for form-bound coaction with and omnidirectional engagement with abutments on the side-walls of the ceremonial casket.

13. An arrangement according to claim 5, wherein the ceremonial casket includes a portal-like supportive frame structure including an upper part formed by the upper part of the ceremonial casket and portal legs formed by opposing end-walls of the ceremonial casket, and the upper part and the portal legs are fixed angle-rigid to one another.

14. An arrangement according to claim 5, wherein said inner casket includes a bottom part and a top part which are joined in a form-bound fashion by intermediate side-strips, and respective longitudinally extending side-strips are provided on their outer surface with a laterally facing and longitudinally extending groove whose opposing walls form downwardly and upwardly directed abutment elements for form-bound coaction with and omnidirectional engagement with abutments on the side-walls of the ceremonial casket.

* * * * *